US006854610B2

(12) United States Patent
Adams

(10) Patent No.: US 6,854,610 B2
(45) Date of Patent: Feb. 15, 2005

(54) DOOR HOOK WITH INTERLOCKING HOOK SEGMENTS

(75) Inventor: William E. Adams, Harmony, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 10/379,056

(22) Filed: Mar. 4, 2003

(65) Prior Publication Data

US 2004/0173550 A1 Sep. 9, 2004

(51) Int. Cl.[7] ..... A47F 5/00

(52) U.S. Cl. ..... 211/118; 248/215; 248/201; 248/339

(58) Field of Search ..... 211/118, 113; 248/214, 215, 301, 339

(56) References Cited

U.S. PATENT DOCUMENTS

| | | | | | |
|---|---|---|---|---|---|
| 1,474,660 | A | | 11/1923 | White | |
| 1,540,556 | A | | 6/1925 | Laurie | |
| 1,611,397 | A | * | 12/1926 | Wells | 211/70.1 |
| 2,288,706 | A | * | 7/1942 | Herr | 248/215 |
| 3,536,286 | A | | 10/1970 | Kramer | |
| 4,034,865 | A | | 7/1977 | Batts et al. | |
| 4,817,239 | A | | 4/1989 | Campbell et al. | |
| 5,087,007 | A | | 2/1992 | Gaderick | |
| D326,021 | S | | 5/1992 | Evenson | |
| 5,171,052 | A | | 12/1992 | Cunningham | |
| D340,672 | S | | 10/1993 | Adams | |
| D342,889 | S | | 1/1994 | Adams | |
| 5,413,297 | A | | 5/1995 | Adams | |
| 5,485,932 | A | * | 1/1996 | Romm et al. | 211/87.01 |
| 5,535,971 | A | | 7/1996 | Adams | |
| 5,553,823 | A | | 9/1996 | Protz, Jr. | |
| D374,168 | S | | 10/1996 | Protz, Jr. | |
| 5,810,304 | A | * | 9/1998 | Lehrman | 248/215 |
| 5,950,337 | A | * | 9/1999 | Lehrman | 38/103 |
| D442,198 | S | | 4/2000 | Snell | |
| 6,224,030 | B1 | | 5/2001 | Hepworth | |
| 6,302,365 | B1 | | 10/2001 | Catanzarite et al. | |
| 6,311,851 | B1 | | 11/2001 | Knudsen, Sr. et al. | |
| D455,947 | S | | 4/2002 | Goodman et al. | |
| 6,364,260 | B1 | * | 4/2002 | Lorincz et al. | 248/215 |
| 6,533,132 | B1 | * | 3/2003 | Weisenburger | 211/70.8 |

FOREIGN PATENT DOCUMENTS

| | | |
|---|---|---|
| GB | 1 563 627 | 3/1980 |

* cited by examiner

*Primary Examiner*—Robert W. Gibson, Jr.
(74) *Attorney, Agent, or Firm*—Buchman Ingersoll PC

(57) ABSTRACT

An over the door hook has a U-shaped bracket with at least one curved hook sized to receive a hook segment. Two or more plastic hook segments have an opening at an upper end and a curved hook at the lower end. The curved hook of one segment fits through the opening in another hook segment. The two segments are locked together by a tab or tooth in one segment that fits into a slot or recess in a second segment. An alternative is to provide a boss adjacent the opening at the upper end of one segment that is gripped by the curved hook of the second segment. Similar locking arrangements can be provided to lock a hook segment to the U-shaped bracket.

40 Claims, 12 Drawing Sheets

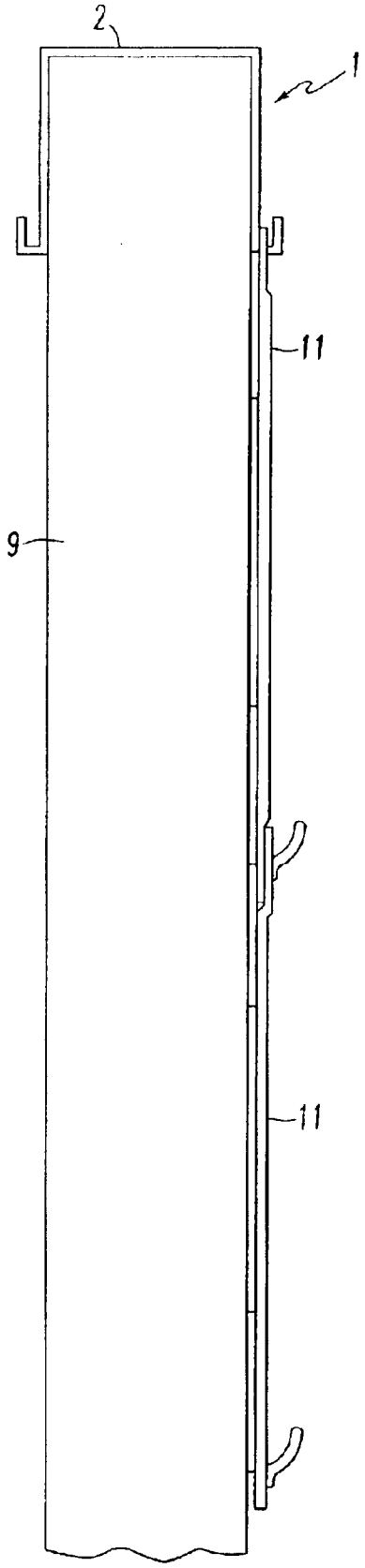
FIG. 1
FIG. 2
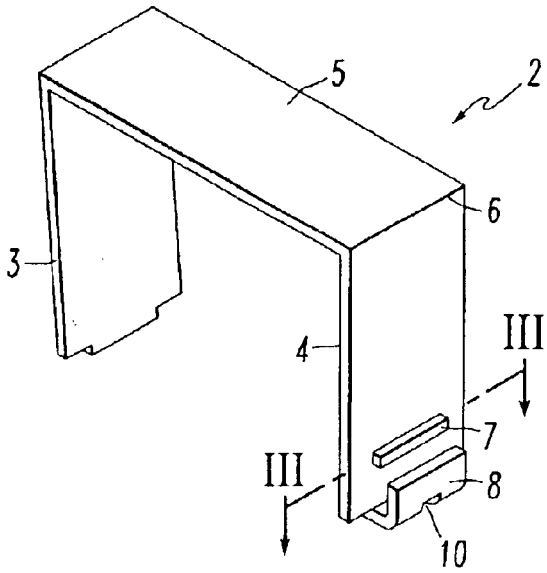
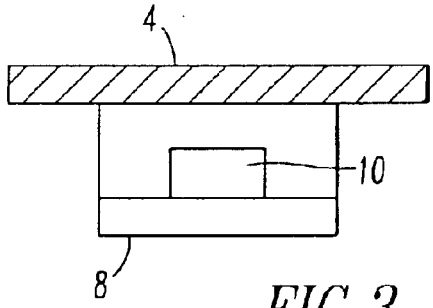
FIG. 3

FIG. 7
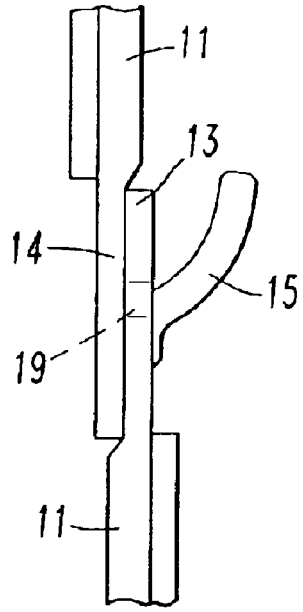
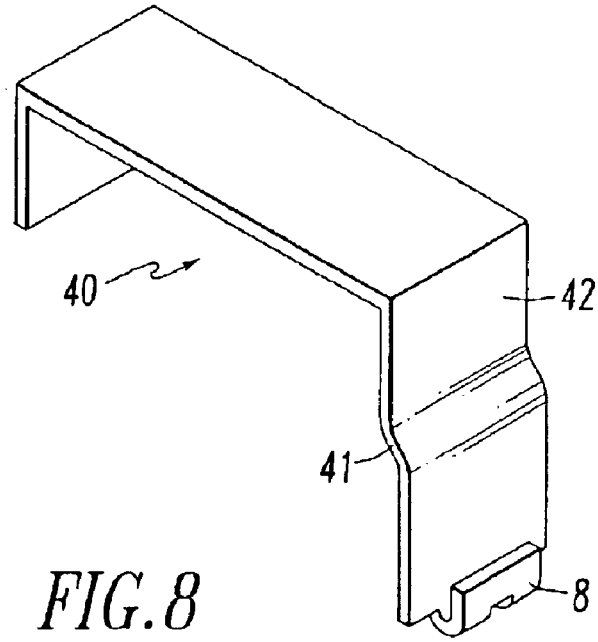
FIG. 8

DOOR HOOK WITH INTERLOCKING HOOK SEGMENTS

BACKGROUND OF THE INVENTION

1. Field of the Invention

The present invention relates to improvements in an over-the-door hook.

2. Description of the Prior Art

There are a variety of hooks that fit over the top of a door. One common type of hook has a U-shaped bracket having an opening not greater than the width of the door hook to which it is to be attached. One or more hooks extends from either or both sides of the bracket. Examples of this type of door hook are disclosed in U.S. Pat. No. 4,817,239 to Campbell et al. and U.S. Pat. No. 6,302,365 to Catanzarite et al. and U.S. Des. Pat. No. Des. 342,889 to Adams, U.S. Des. Pat. No. 422,198 to Snell and U.S. Des. Pat. No. 455,947 to Goodman et al. These door hooks are made of plastic or metal and are unitary structures. One shortcoming of this type of hook is that the bracket is sized to fit doors having the same width or a slightly smaller width as the opening in the bracket. The hooks are not adjustable either in the width of the bracket or the level at which the hook portion is positioned relative to the top of the door. Consequently, the art has recognized a need for an over-the-door hook that will fit over a wider range of door widths.

One type of over-the-door hook that will fit a wider range of doors is disclosed in U.S. Des. Pat. No. 326,021 to Evenson. That door hook has two L-shaped members that fit together in a manner to form an adjustable U-shaped hook. The two L-shaped members are connected by a tongue and groove type joint that enables them to slide apart from and toward one another thereby changing the width of the hook. A significant shortcoming of this hook is the thickness of that portion of the hook that fits on top of the door. That thickness prevents many doors from being tightly closed. Another approach to providing a door hook that fits over a wider range of door widths is to provide a U-shaped bracket in which the legs of the bracket angle toward one another and can flex away from one another. This type of hook is disclosed in my U.S. Des. Pat. No. 342,889. This type of hook is more likely to jam a door than is a door hook having the bracket with an opening that is the same as the width of the door. The hook must be thick enough to allow the plastic to fill the entire mold cavity. That thickness coupled with the excess width of the top of the bracket beyond the width of the door creates this problem.

Another type of over the door hook is the sectional wreath hanger in which it is possible to select the level at which the hook is positioned relative to the top of the door. Two sectional wreath hangers are disclosed in U.S. Pat. No. 5,553,823 and U.S. Des. Pat. No. 374,168 to Protz, Jr. and U.S. Pat. No. 6,311,851 to Knudsen, Sr. et al. Both wreath hangers have three different pieces, a U-shaped bracket that fits over the door, a J-hook and an extension member that fits between the U-shaped bracket and the J-hook. Protz teaches that one or more extension members can be used. Knudsen provides a series of holes in the U-shaped bracket, J-hook and extension member so that the pieces can be fitted together to create a range of selected lengths. Knudsen also teaches that the sections can be made of any suitable material known in the art including various plastics, metals, wood, composites and the like. Both patents illustrate all three pieces as having the same thickness, and all pieces are similarly shaded. Thus, one skilled in the art would understand that all three pieces are made of the same material. Indeed, it has been customary in the art to make door hooks entirely of plastic or entirely of metal. Those sectional wreath hangers available in the marketplace are entirely made of plastic. The art has failed to offer sectional door hooks in which one or more sections are plastic and other section or sections are metal.

In designing an over-the-door hook, the objective has always been to create an inexpensive hook that will fit the door while that door is open or closed and that will hold significant weight. Clear plastics are often used because they are cheaper than metal and less noticeable. But, it is very difficult to mold thin sections of plastic because plastic does not flow well through thin openings. Consequently, plastic door hooks have been over 0.080 inches thick and many are 0.125 inches thick. Many of these door hooks are too thick to close a door safely without damaging the door. This is particularly true of newer doors that have tight seals between the door and the jamb. The thicker door hooks have, in many cases, actually weakened the very hinges that hold the door, and also compressed and damaged wood in both the door and the jamb. If the over-the-door hook is too thick, the door may not close or when it does close it may not latch. Locks and latches on the door may be forced downward so that they no longer engage openings in the jamb.

Plastic is being used for many of the over the door hooks being sold, particularly those sold for hanging wreaths and other holiday decorations. But, plastic door hooks which are thin enough to close a vast majority of doors safely may not hold objects of significant weight when the door is open. The weight of the object being hung lifts the door hook and the object falls to the floor.

Metal door hooks can be made thin enough to fit between a closed door and the door jamb without causing damage. But metal door hooks are more expensive. This is particularly true if one seeks to make a multiple piece, or sectional, wreath hook of metal. Metal hooks also have sharp edges. When the wreath swings back and forth, they often scratch the door.

There is a need for an over-the-door hook which can hold significant weight when the door is open, and which permits the door to be closed without damaging the door and which can be configured or adjusted to be one of several selected lengths.

SUMMARY OF THE INVENTION

An object of the present invention is to provide a door hook that is thin enough to fit between the top of the door and the jamb, and is strong enough to hold significant weight such as a decorative wreath when the door is open.

The door hook of the present invention is comprised of a U-shaped metal or plastic bracket having a J-hook on either or both sides. One or more hook segments having an opening at one end and a curved hook at an opposite end are securely connected to the J-hook and to one another. Preferably, the bracket is brass or stainless steel and has a maximum thickness of 0.020 inches to 0.030 inches. A coated metal door hook would be 0.03 to 0.06 inches thick. The bracket could be polycarbonate and have a thickness of about 0.060 to 0.080 inches at the top, a width between the sides corresponding to the width of the door over which the hook is placed and sides at least 1⅜ inches long, and preferably 2¼ inches long.

The hook segments should be several identical pieces that can be interconnected and interlock to create hooks of different lengths. Preferably each hook segment is an elongated body having a lower portion with a curved hook extending from that portion of the hook segment. The upper portion of the hook segment has an opening through which the curved hook of another hook segment will fit. The segments are configured to lock together. In one embodiment a slot is provided on the inner surface of the curved hook where the hook meets the body of the hook segment. A tab extends into the opening in the upper portion of the hook segment. The tab is sized and positioned to fit into the slot adjacent the curved hook in another hook segment to lock the two hook segments together. In another embodiment a tooth is provided where the curved hook meets the body. The tooth fits into a recess on the upper edge of the opening. In a third embodiment a boss is provided on the front of the hook segment above the opening. The boss is sized to snap into a curved hook on another hook segment. Preferably the hook segments are a clear plastic like polycarbonate.

I also prefer to provide end portions at either end of the hook segments that have a thickness which is less than the thickness of the elongated body of the hook segment. In preferred embodiments the combined thickness of the upper end of the hook segment and the thickness of the lower end of the hook segment does not exceed the thickness of the elongated body.

Other objects and advantages of the invention will be apparent from the description of certain present preferred embodiments thereof which are shown in the drawings.

BRIEF DESCRIPTION OF THE DRAWINGS

FIG. 1 is a side view of a first preferred embodiment of the door hook hung on a door.

FIG. 2 is a perspective view of the U-shaped bracket used in the embodiment shown in FIG. 1.

FIG. 3 is a sectional view taken on the line III—III in FIG. 2.

FIG. 7 is a side view of the ends of two linked hook segments.

FIG. 8 is a perspective view of a U-shaped bracket in a second embodiment of the door hook.

DESCRIPTION OF THE PREFERRED EMBODIMENTS

Figure 4:
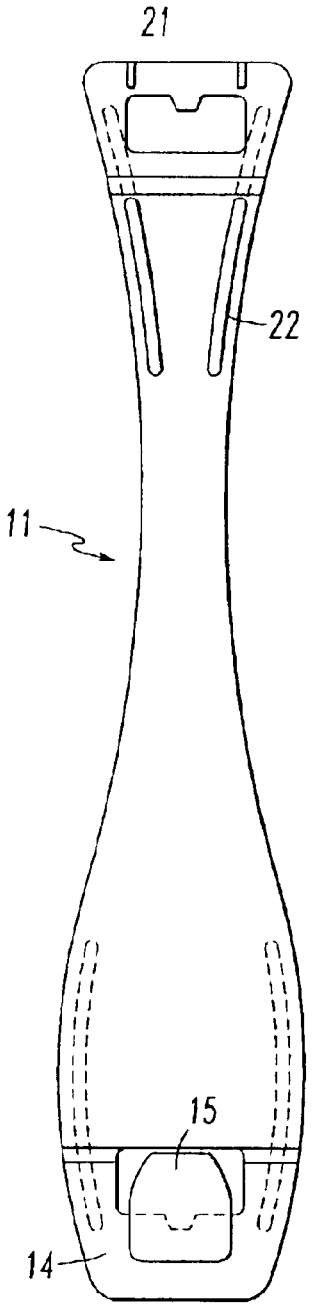
FIG. 4 is a front view of the hook segment used in embodiment shown in FIG. 1.

A first embodiment of an over-the-door hook 1 is shown in FIGS. 1 through 7. This hook has a U-shaped bracket 2 having a back portion 3, a front portion 4, and a top 5. The front portion is attached to the front edge 6 of the top and the back portion 3 is attached to a rear edge of the top. In a preferred embodiment the U-shaped bracket is a metal stamping. In another embodiment the U-shaped bracket is clear polycarbonate. The bracket is molded in a mold whose parting line corresponds to a centerline through the bracket from the front portion to the rear portion. For easier removal from the mold by ejector pins the top is tapered from that centerline to the edges. The top has a thickness of near 0.080 inches at the centerline tapering to a thickness less than 0.070 inches at the edges. The front portion and back portion are at least 1.375 inches long and the distance between the front portion and the back portion is about the same as the width of a door on which the hook will be placed. This combination of length and width prevents the bracket from being easily pulled off the door 9. Preferably these portions are from 2.25 to 3.00 inches long. When one of these portions is less than 1.375 inches in length a wreath or other object of similar weight hung on the other portion will pull the hook from the door. Similarly, when the hook is wider than the width of the door, it is more easily dislodged by a wreath or other object hung on the door. Therefore, the distance between the front portion and the rear portion at the top should be equal to, or not more than 0.025 inches greater than, the width of the door. Preferably the back portion and the front portion are angled toward one another. I prefer the angle between the top and the front portion and the angle between the top and the back portion to be about 85°. The angle provides a snug fit on those doors whose width is slightly less than the standard size for that type of door. The lower edge of either or both of the back portion 3 and the front portion 4 is curved to form a J-hook 8. A slot 10 is cut in the bottom of the J-hook at an angle to the front portion 4. That is, a line normal to a diameter of the slot would pass through the front portion 4 rather than be parallel to or angled away from that front portion. Because the slot is cut at that angle any flashing around the slot will not scratch a door over which the bracket is placed. Furthermore, the hook segment 11 that is being held by the J-hook will extend away from the door. If desired, a ridge 7, shown in FIG. 2, can be provided above the J-hook 8 to abut the top of a hook segment and provide side-to-side stability. The back portion 3 can be of similar shape having a J-hook at the bottom. For convenience and to distinguish the hook or hooks on the U-shaped bracket from the over-the-door hook itself, the hook 8 on either or both of the front portion and back portion is identified as a J-hook. However, it should be understood that the shape of the hook could be any shape that functions as a hook. Whether or not a J-hook is provided at the bottom edge of both the front portion and the rear portion, those bottom edges should be curved or beveled to prevent scratching of the door. A dog leg portion can be provided in either portion to extend the bottom of that portion away from the door. FIG. 8 illustrates a U-shaped bracket 40 with the dog leg portion 41 in the front segment 42.

Referring to FIGS. 4, 5, 6 and 7, the hook segments 11 have an elongated body 12 with an upper end portion 13 and a lower end portion 14. A curved hook 15 extends from the lower end portion 14 opposite an opening 16. This aperture 16 is provided to permit easier molding of the curved hook. A slot 17 is provided in the lower portion 14 at a point where the curved hook 15 meets the lower end 14. The upper end 13 has an aperture 18 sized to receive the curved hook 15 of another hook segment and to receive the J-hook 8 of the U-shaped bracket. A tab 19 extends from the upper end portion 13 into the aperture. The tab could extend outward above the top surface of the hook segment and could be many different shapes. Tab 19, however shaped, is sized and positioned to fit in a similarly shaped slot 17 of another hook segment when the two segments are connected as shown in FIG. 7. In the hook segment shown in FIGS. 4 through 7, the tab 19 is rectangular and extends from the top of the opening 18. The slot 17 opens to the back of the hook segment and to the inside surface of curved hook 15. If desired tab 19 could extend from the bottom of the opening and slot 17 would extend from the outside surface of the curved hook 15 into that hook.

Figure 5:
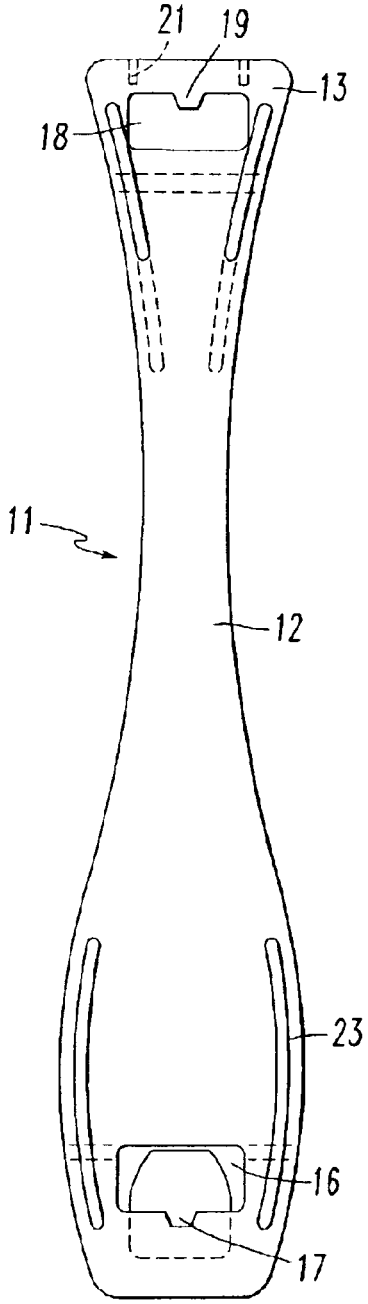
FIG. 5 is a rear view of the hook segment shown in FIG. 4.
Figure 6:
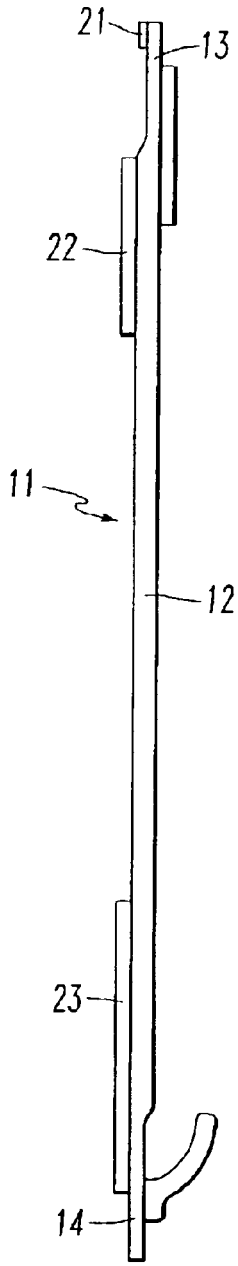
FIG. 6 is a side view of the hook segment shown in FIGS. 4 and 5.

The hook segments are preferably made from clear polycarbonate. However, these parts could be metal stampings. In the preferred polycarbonate form, the elongated body has a selected thickness which is about 0.125 inches. The upper portion and lower portion are thinner, preferably about half the thickness of the elongated body. Constructing the ends to be thinner enables the hook segments to fit together as shown in FIG. 7 such that there will be a single plane that passes through all interconnected hook segments. Additionally, the hook surface of every connected hook segment can then be a common plane. When the hook segments are made of polycarbonate or another plastic, I prefer to provide ribs 21, 22, 23 on the hook segment as shown in FIGS. 4, 5 and 6 to strengthen the segment. These ribs are not needed if the hook segments are metal.

The door hook can be assembled to contain the U-shaped bracket 2 and one or more hook segments 11. The first segment is placed on the J-hook so that the tab 19 of the hook segment extends through the slot 10 in the J-hook portion of the bracket. This connection locks the hook segment to the bracket. Additional hook segments can be connected to the first hook segment as shown in FIGS. 1 and 7. When two hook segments are connected together the curved hook 15 of the upper hook segment will extend through the aperture 18 in the lower hook segment. The tab 19 of the lower hook segment will be in the slot 17 of the upper hook segment, locking the two segments together and preventing them from moving relative to one another.

I prefer to provide three sizes of U-shaped brackets for exterior and interior doors. The brackets are identical except for the bracket width measured as the distance between the front portion and the rear portion. Two large sizes having widths of 1.375 to 1.4 and 1.75 to 1.8 inches will fit most common interior and exterior doors. A smaller bracket having a width of 0.5 to 0.525 inches will fit a storm door or screen door. The product can be sold in a package containing one large bracket, one small bracket and from two to six hook segments.

Figure 9:
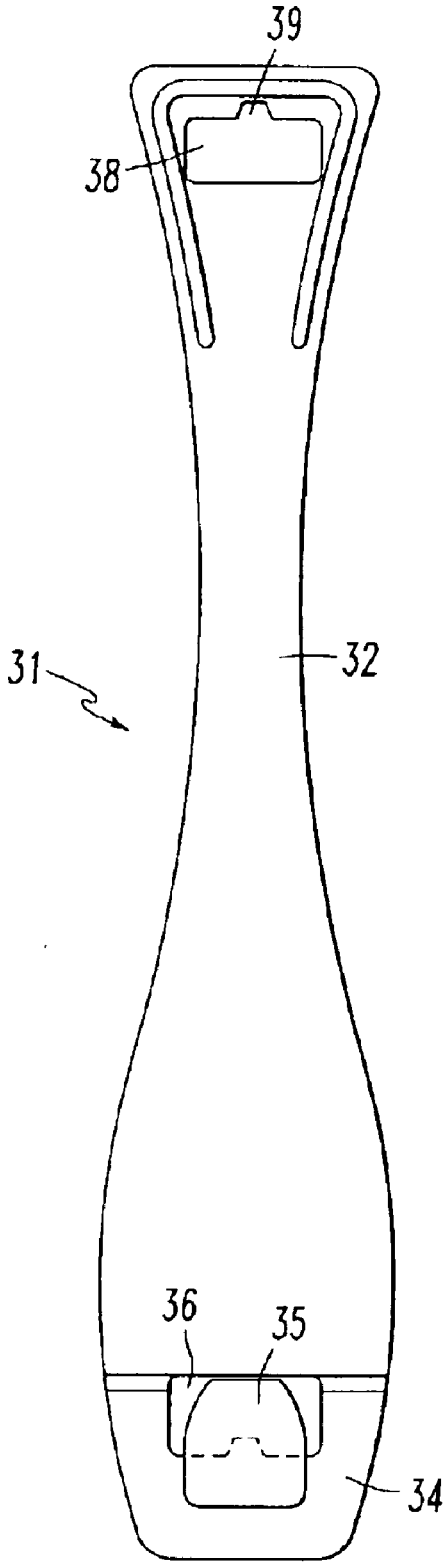
FIG. 9 is a front view of a second preferred embodiment of a hook segment that can be used in a door hook similar to that shown in FIG. 1.

Other locking arrangements besides the tab and slot used in the hook segment 11 can be provided. One such arrangement is used in hook segment 31 shown in FIGS. 9 and 10. This hook segment is similar in shape to hook segment 1. However, the opening 38 in the upper end 33 of the hook segment 31 has a recess 39 along its top edge. Curved hook 35 extends from the lower end portion 34 over opening 36. A tooth 37 extends upward from the inside surface of curved hook 35. The tooth 37 and recess 39 are sized and positioned so that the tooth 37 of one hook segment is within the recess 39 of another hook segment when the two segments are connected together. A rib 24 is provided on the back surface of the elongated body 32 of this hook segment. As in the embodiment of FIGS. 4 through 7 the elongated body 32 of the hook segment 31 is thicker than ends 33 and 34. Indeed, the combined thickness of ends 33 and 34 should not be greater than the thickness of the body 32.

Figure 11:
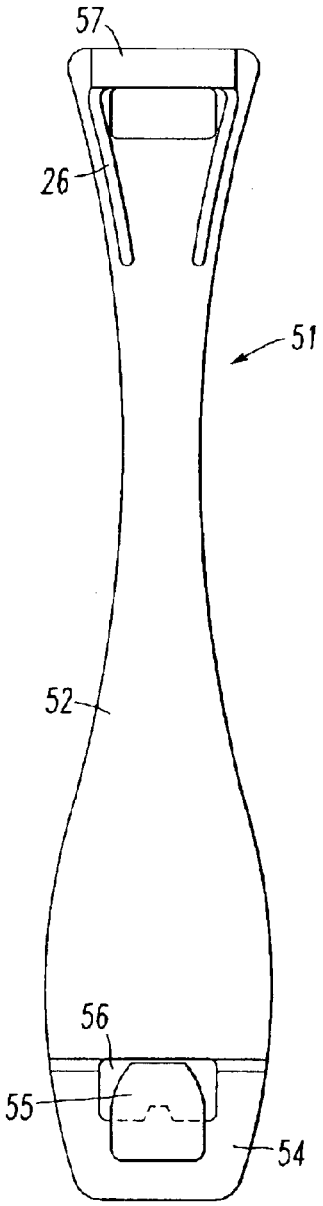
FIG. 11 is a front view of a third present preferred embodiment of a hook segment that can be used in a door hook similar to that shown in FIG. 1.
Figure 12:
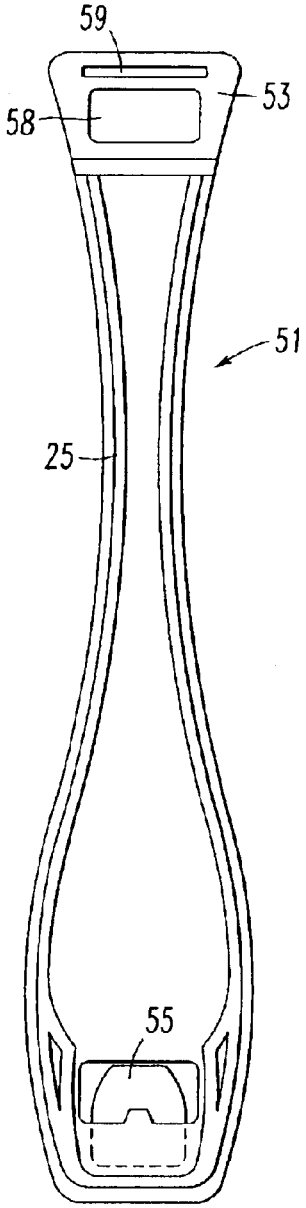
FIG. 12 is a rear view of the hook segment shown in FIG. 11.
Figure 13:
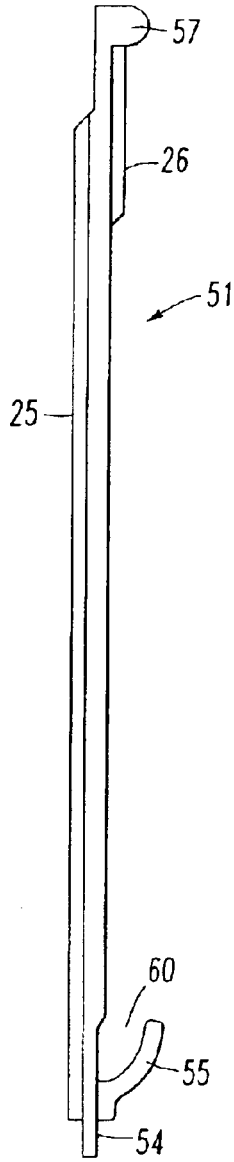
FIG. 13 is a side view of the hook segment shown in FIGS. 11 and 12.

Yet another embodiment of the hook segment 51 is shown in FIGS. 11, 12 and 13. As in the previous embodiments hook segment 51 has an elongated body 51 of a selected thickness. End portions 53 and 54 are provided at opposite ends of the elongated body 52. These portions are thinner than the elongated body. An aperture 58 is provided in the upper end. A curved hook 55 on the lower end 54 is sized to fit through opening 58. A boss 57 is positioned above opening 58 on the front of the upper end. The vertical diameter of the boss 57 and the diameter from the back surface of end portion 53 to the outer most point on the front of the boss 57 are the same or very close. This diameter is slightly greater than the opening 60 at the mouth of hook 55. Hook 55 can flex allowing the boss 57 to snap into opening 60. The same snap-fit allows common sized rods or dowels to snap into the hook and be held securely. A slot 59 extends from the back surface of end 53 into boss 57. This slot reduces shrinkage during molding.

Figure 14:
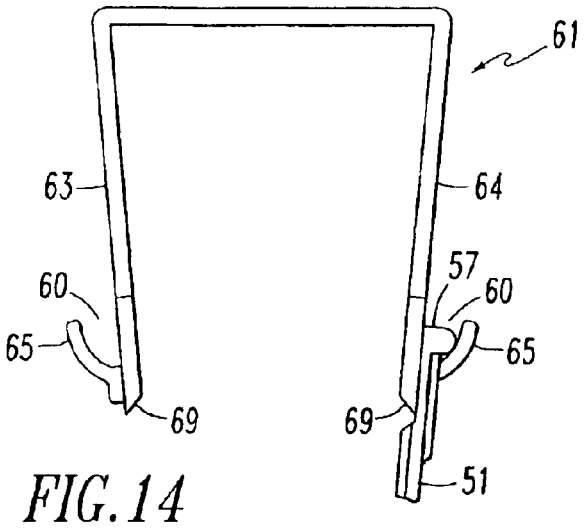
FIG. 14 is a side view of a U-shaped bracket which can be used to hold the hook segment shown in FIGS. 11, 12 and 13.

The U-shaped bracket 61 shown in FIG. 14 has a J-hook 65 which is of a similar size and shape as the curved hook 55. Consequently, the boss 57 of the hook segment 51 will snap into opening 60 formed by hook 65 in the front portion 64 or rear portion 63 of the bracket 61. This snap-fit is the same type of fit that is made by two connected hook segments. The bottom of the front portion 64 and the rear portion 63 can have a beveled edge 69 to permit the bracket to fit more easily over the door.

Figure 10:
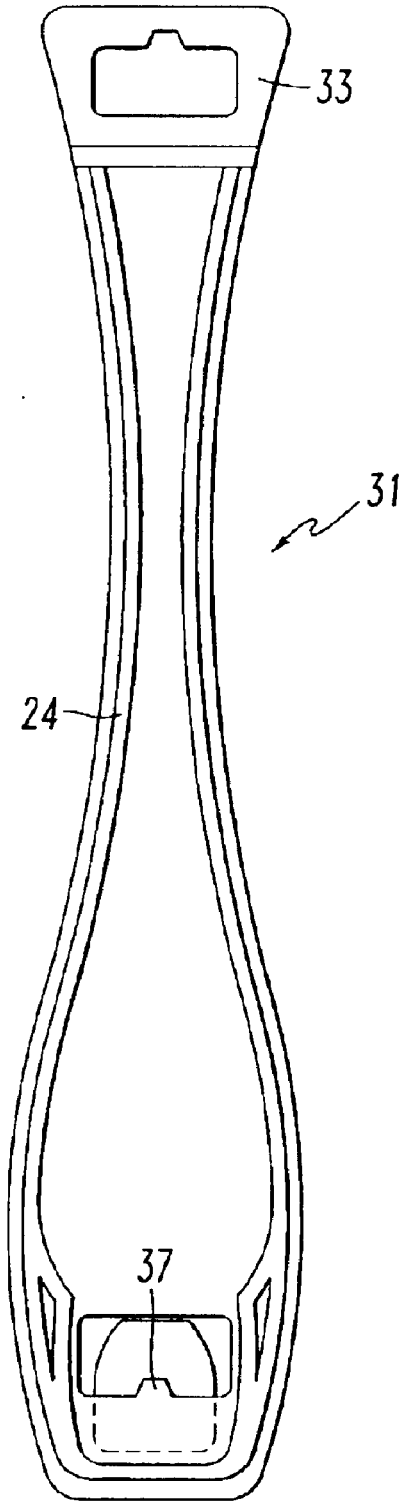
FIG. 10 is a rear view of the hook segment shown in FIG. 9.
Figure 15:
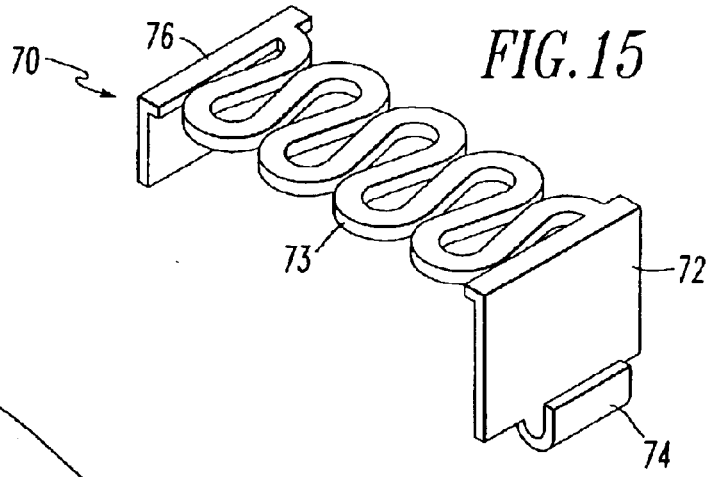
FIG. 15 is a perspective view of another U-shaped bracket which can be used to hold any of the door hook segments shown in the drawings.
Figure 16:
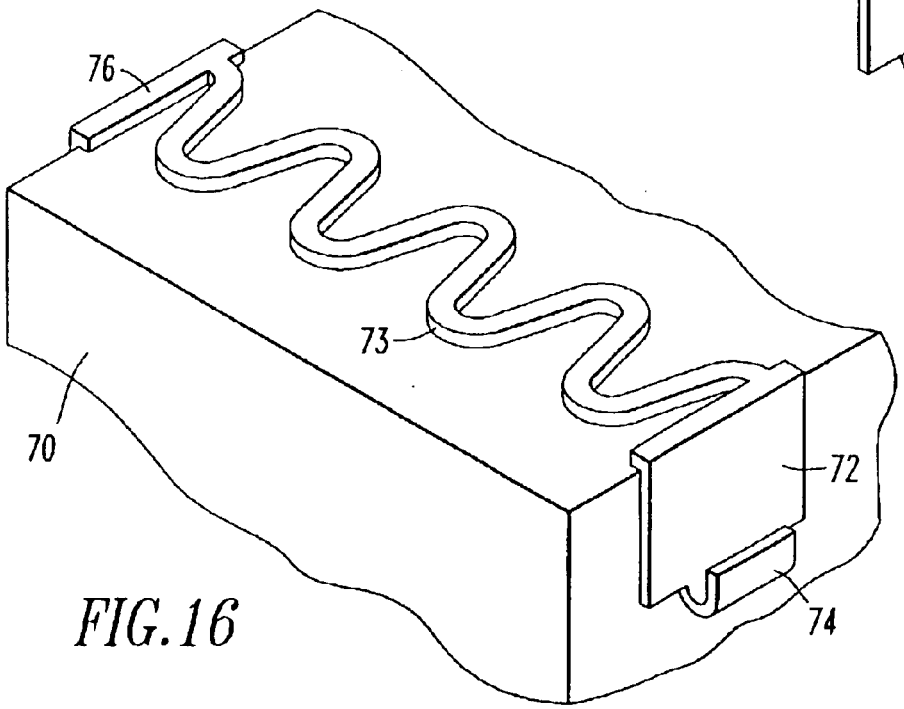
FIG. 16 is a perspective view of the bracket shown in FIG. 15 positioned on a door.

Another U-shaped bracket 71 which can hold the hook segments shown in the drawings is illustrated in FIGS. 15 and 16. There is a front portion 72 with a J-hook portion 74 and a rear portion 76 connected together by a flat spring 73. Hook segments are attached to the J-hook portion as in the previous embodiments. To place the over-the-door hook with spring 73 on the top of the door 70 as shown in FIG. 10, one pulls the front side 72 away from the back side 76 a distance greater than the width of the door 70. Then one places the extended over-the-door hook on top of the door 70. Once in position the user releases the sides allowing spring 73 to attempt to return to its original position. As a result, the spring forces the front side and back side against the front and rear faces of the door tightly holding the hook onto the top of the door. In a preferred embodiment the spring 73 has a thickness of not more than 0.030 inches and preferably not more than 0.020 inches A spring this thin will fit on most any door allowing that door to be easily opened and closed without interference from the over-the-door hook. This is particularly true of metal doors and exterior doors with weather seals that will not close properly with thicker hooks. In a most preferred embodiment the over-the-door hook is brass or stainless steel. Furthermore, at least one edge of the spring is slightly rounded or rolled. Preferably, the sides 72 and 76 are at right angles to the spring 33. However, either or both sides could be angled inward toward the bottom of the spring.

If the spring or top is plastic the thickness of the spring must be greater than 0.050 inches for most plastics. Otherwise, the plastic will not readily flow throughout the mold cavity that forms the top or spring. Commercial embodiments of the door hook in U.S. Pat. No. 5,413,297 have a top portion that is 0.110 inches thick. However, springs that thick will interfere with door closing, particularly when used on tight-fitting doors. Yet, if the plastic top or spring has a thickness of less than 0.050 inches it can break easily and a plastic spring may not have enough memory to enable the over-the-door hook to tightly grip the door. For these reasons, the spring 73 preferably is metal. The front and back portions of the U-shaped bracket could be plastic. But, if the spring is metal it is cheaper to make the entire bracket metal. It should also be apparent to those skilled in the art that one could make the spring of metal and the remaining parts plastic. In that event, the ends of the spring may be molded into the front portion and rear portion of the over-the-door hook.

Figure 17:
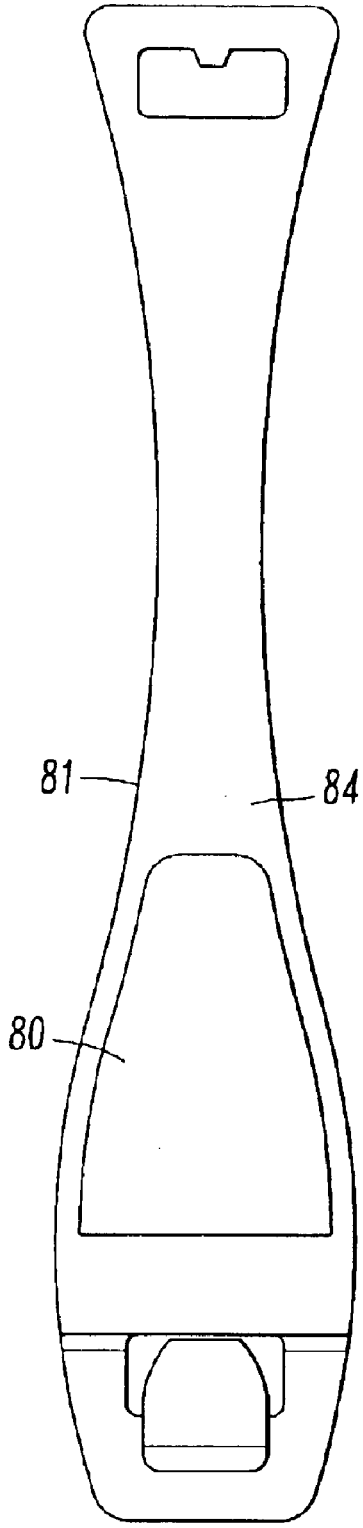
FIG. 17 is a front view of a hook segment having a card holding finger.
Figure 18:
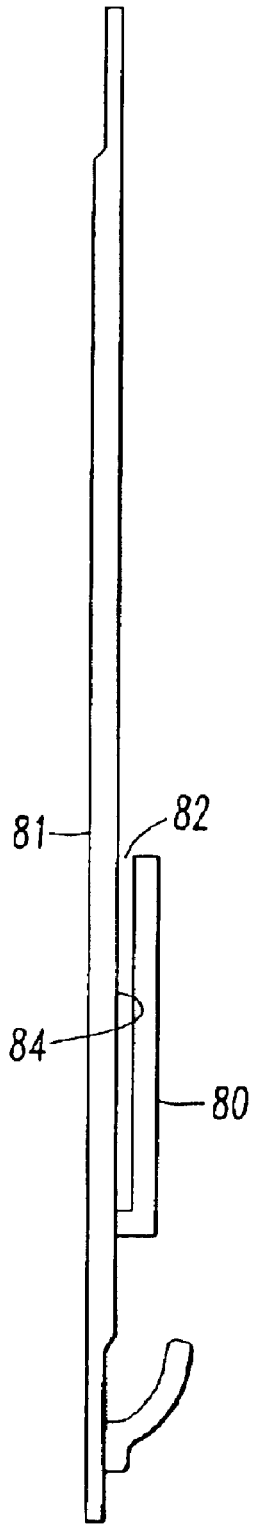
FIG. 18 is a side view of the hook segment shown in FIG. 17.
Figure 19:
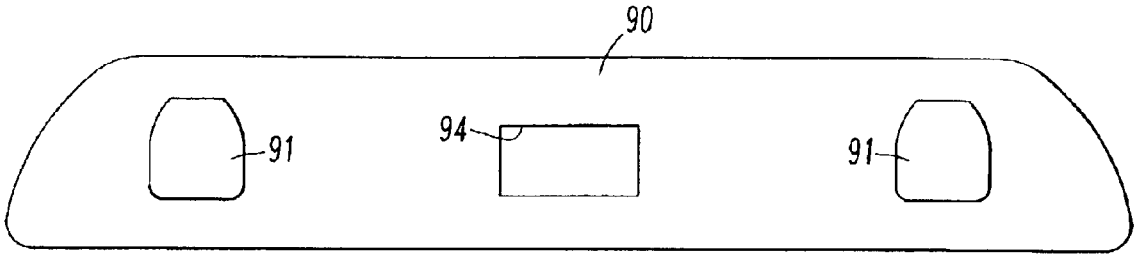
FIG. 19 is a front view of a link that can be used in combination with any of the U-shaped brackets and hook segments shown in the drawings.

Any of the hook segments shown in the drawings could be modified to include additional curved hooks or other structures on the top surface of the hook segment. In the embodiment of FIGS. 17 and 18 the L-shaped hook or finger 80 is provided on hook segment 81. The opening 82 between the finger 80 and the top surface 84 of the hook segment is narrow so that the finger 80 can grip a greeting card. Longer hook segments, preferably about twelve inches long, each holding more than one card may be used. A hinge, indicated by broken line 83, may be provided between the lower end and the upper end to enable the hook segment to be folded in half for packaging. If desired, more than one bracket and attached hook segments could be placed on a single door. Then, several cards could be hung in parallel lines on the door.

Figure 25:
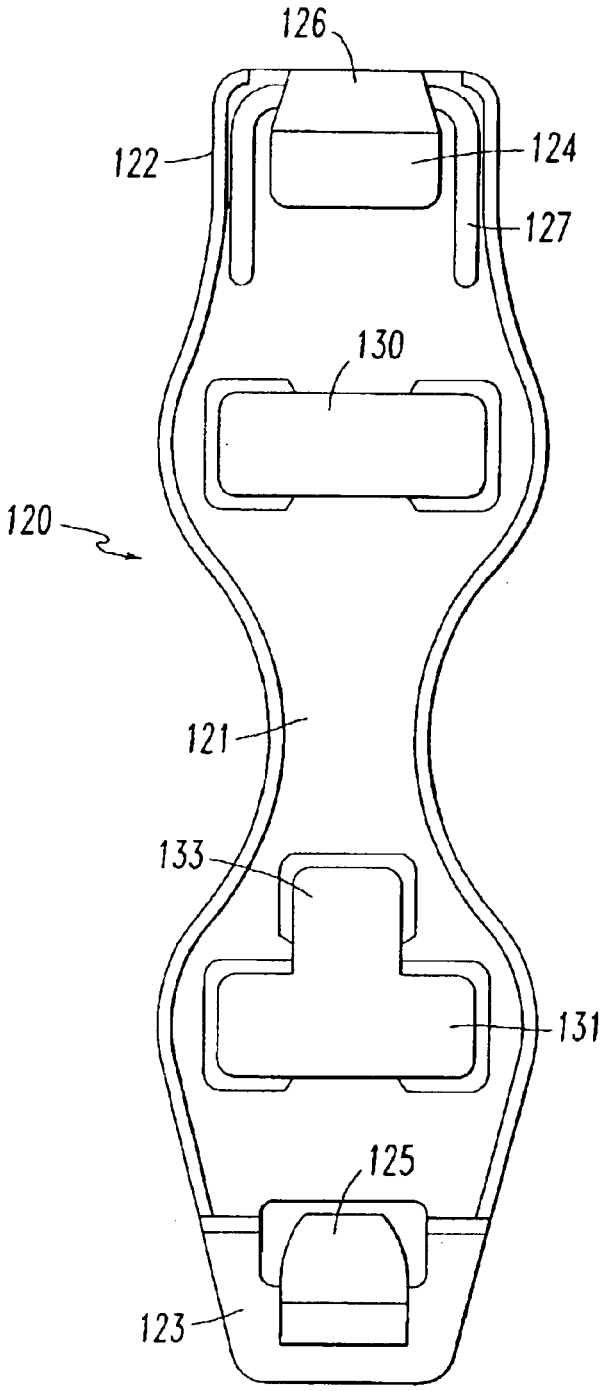
FIG. 25 is a front view of another present preferred embodiment of a hook segment.
Figure 26:
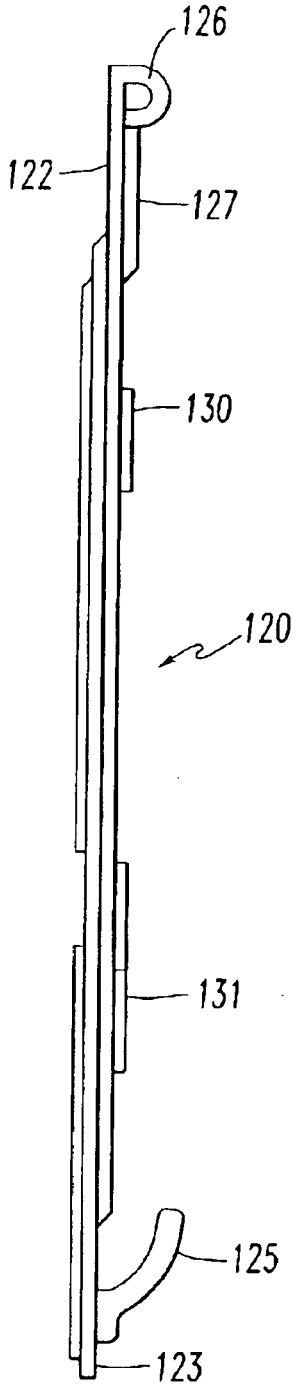
FIG. 26 is a side view of the embodiment of FIG. 25.

A second hook segment configured to hold greeting cards is shown in FIGS. 25 and 26. That hook segment 120 has an elongated body 121 with an upper end 122 and lower end 123. As in the previous embodiments, an opening 124 is provided on the upper end and a hook 125 is provided on the lower end. A projection 126 is provided above opening 125 which snaps into another hook segment, similar to boss 57 in the embodiment shown in FIGS. 11, 12, 13 and 14. A reinforcing rib 127 partially surrounds the opening 124. Clips 130, 131 are provided on the elongated body. The center of clip 130 is attached to the elongated body. Consequently, one greeting card may be held in the right side of clip 130 and a second card can be held in the left side of clip 130. Clip 131 is similar to clip 130, but also has an upper tab 133 that can receive the lower edge of a card and hold the card vertically. If desired, the clips could have a decorative configuration. Such configurations might include a Christmas tree, snowman, pumpkin, Easter egg or other symbols of holiday seasons or could be a sun or smiley face or even a corporate logo or symbol.

Figure 20:
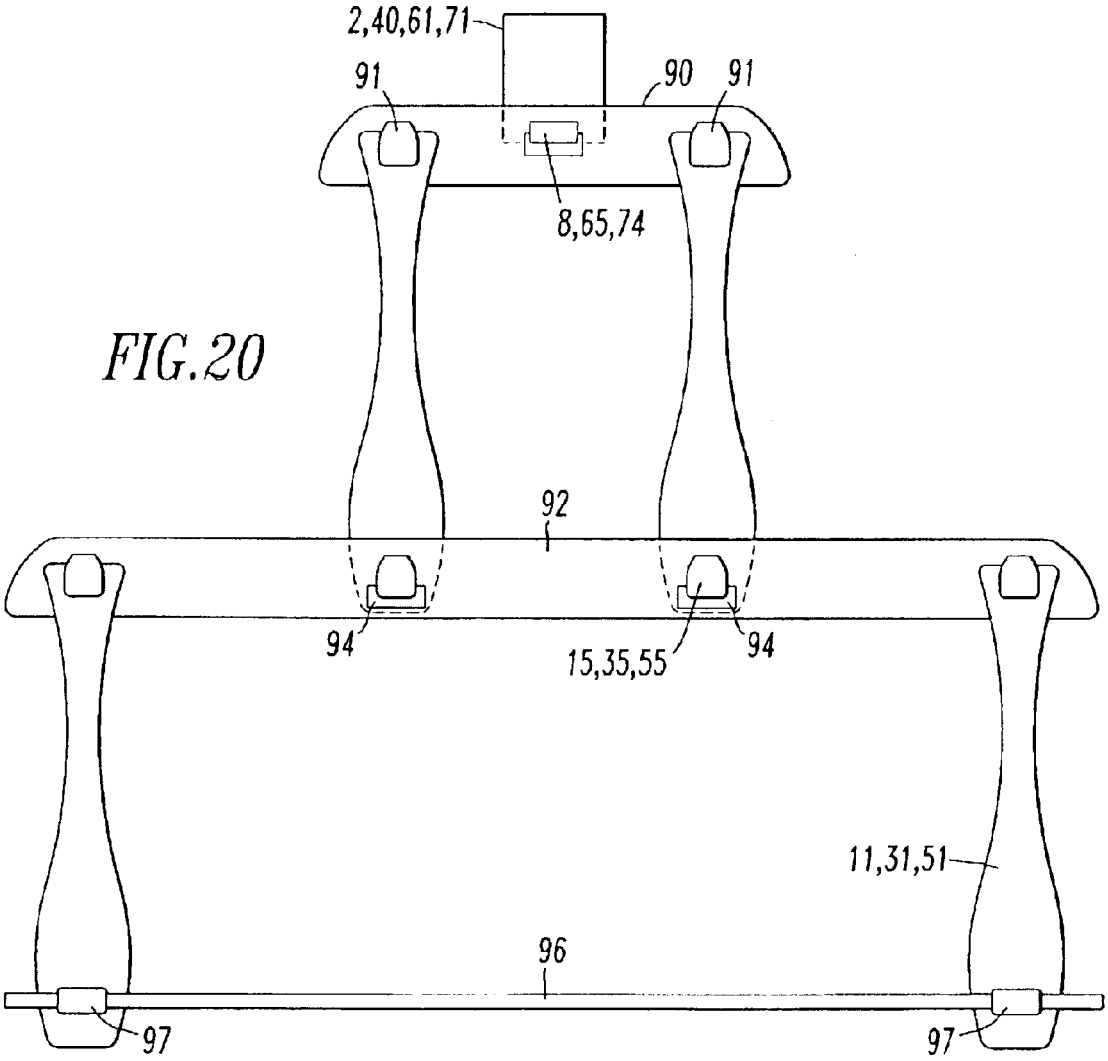
FIG. 20 is a front view of a display created by assembling a U-shaped bracket with multiple links and hook segments.
Figure 21:
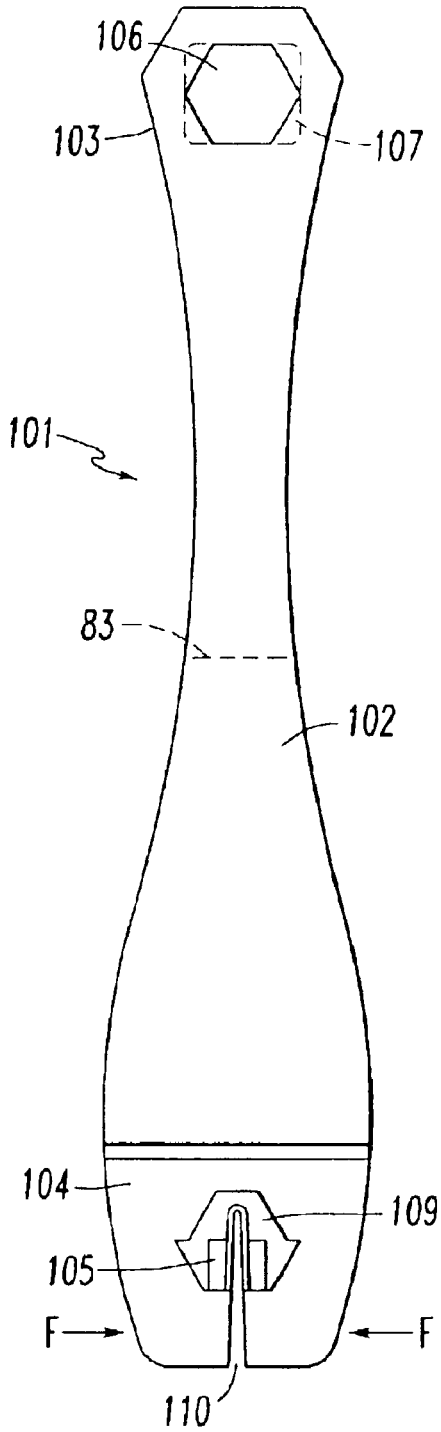
FIG. 21 is a front view of another present preferred embodiment of a hook segment.

Horizontal links 90 and 92 such as are shown in FIGS. 20 and 21 could be used in connection with the U-shaped bracket 2, 61 or 71 and hook segments 11, 31 or 51 to create a display. U-shaped brackets (not shown) could be provided on the sides of the door to stabilize long or wide displays such as might be used for card holders. The ends of the links 90, 92 could be identical having a curved hook 91 at either end which is sized to receive the upper end of a hook segment 11, 31, 51. The links could be made in several lengths and have multiple curved hooks 91. An opening 94 is provided at the center of the link. The opening 94 is sized to receive a curved hook 15, 35 or 55 from a hook segment 11, 31 or 51 or a J-hook 8, 65 or 74 from a U-shaped bracket 2, 40, 61 or 71. One could also use pairs of spaced apart hook segments to support a rod 96. The hooks 97 could extend outward a few inches from the hook segments, or spacers could be attached between the hook segment and the rod. Then the rod 96 could be spaced away from the door a sufficient distance to hold a towel. In a preferred embodiment the rod is fiberglass and ¼" in diameter. The spaced apart hook segments could be supported as shown in FIG. 20 and could be supported by separate brackets 2 that fit over the door as in FIG. 1.

Figure 22:
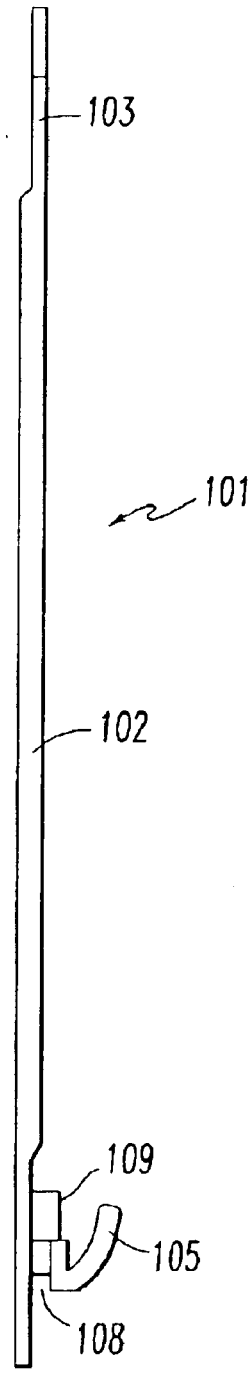
FIG. 22 is a side view of the hook segment shown in FIG. 21.
Figure 23:
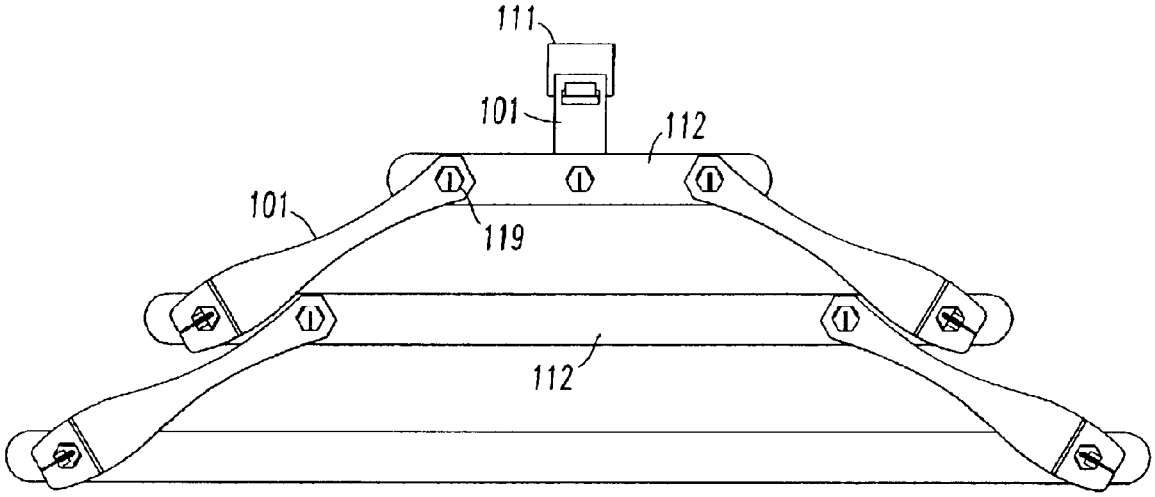
FIG. 23 is a front view of a display created with hook segments of the type shown in FIGS. 21 and 22.
Figure 24:
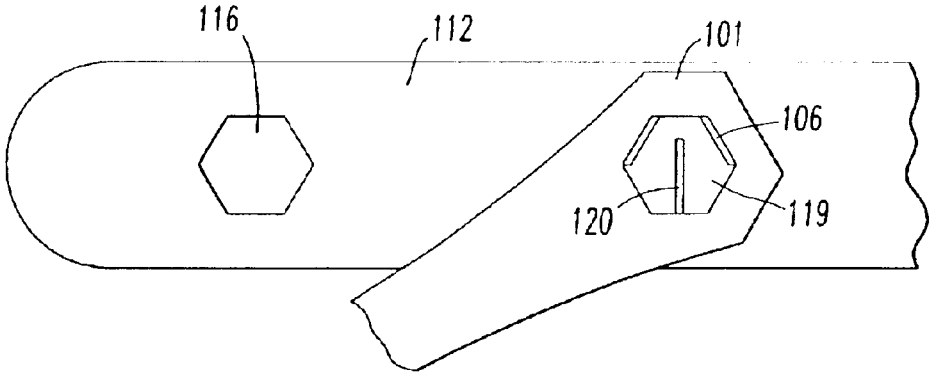
FIG. 24 is a fragmentary view of the end of a hook segment attached to the end of a horizontal link in the display of FIG. 23.

Another present preferred embodiment of a hook segment is shown in FIGS. 21 and 22. This hook segment 101 has an elongated body 102 with an upper end 103 and lower end 104. Instead of having a generally rectangular opening at the upper end, as indicated by the dotted lines in FIG. 21, triangular tabs 107 are provided to create a hexagon shaped opening 106. A split hook 105 on split base 109 is provided on the lower portion 104 of the hook segment. The hook base 109 has a generally hexagonal shape with the upper half being slightly smaller than opening 106 and the lower half being sized to be larger than opening 106. Consequently, base 109 is sized to fit through opening 106 when the lower end 104 is squeezed together as indicated by arrows F. After the lower portion of the hook is fitted through an opening 106 of another hook segment the forces F are released. That allows the hook to return to its original shape shown in FIG. 21. Base 109 is configured to have a slot 108 around the lower half of the base 109. The upper portion of a second hook segment will be in that slot when two hook segments are connected together. Consequently, when two hook segments are put together the segments can be oriented to be co-linear or one hook segment could be at a 60° angle to the other hook segment. The hexagonal opening 106 and base 109 permit the creation of the display such as is shown in FIG. 23. In that display a U-shaped bracket 111 is fitted over the top of the door. This bracket would be similar to other U-shaped brackets here described except that the hook portion on the U-shaped bracket would be similar to the curved hook 105 and base 109 on hook segments 101. In the display of FIG. 23, one hook segment 101 extends from the U-shaped bracket 111. Horizontal link 112 has a hexagonal opening similar to opening 106 in the hook segment. That opening receives hook 105 and base 109 of the first hook segment. Each horizontal link 112 has a base 119 with a slot 120 as can be seen most clearly in FIG. 24. This base may also carry a curved hook. The links may also have hexagonal shaped openings 116 for the receipt of the curved hook 105 and base 109 of the hook segments. The openings 116 and projections 119 are provided on the links 112 to permit links and hook segments to be attached at an angle such as is shown in FIG. 23. Consequently, a Christmas tree-like display can be created with the hook segments and links. Then garland or decorative light strings can be strung on the links and hook segments to create an ornamental display. Other polygon shapes such as an octagon or pentagon could be used for the openings 106, 116 and the base 109 or projection 119 if orientations other than 60° are desired.

Figure 27:
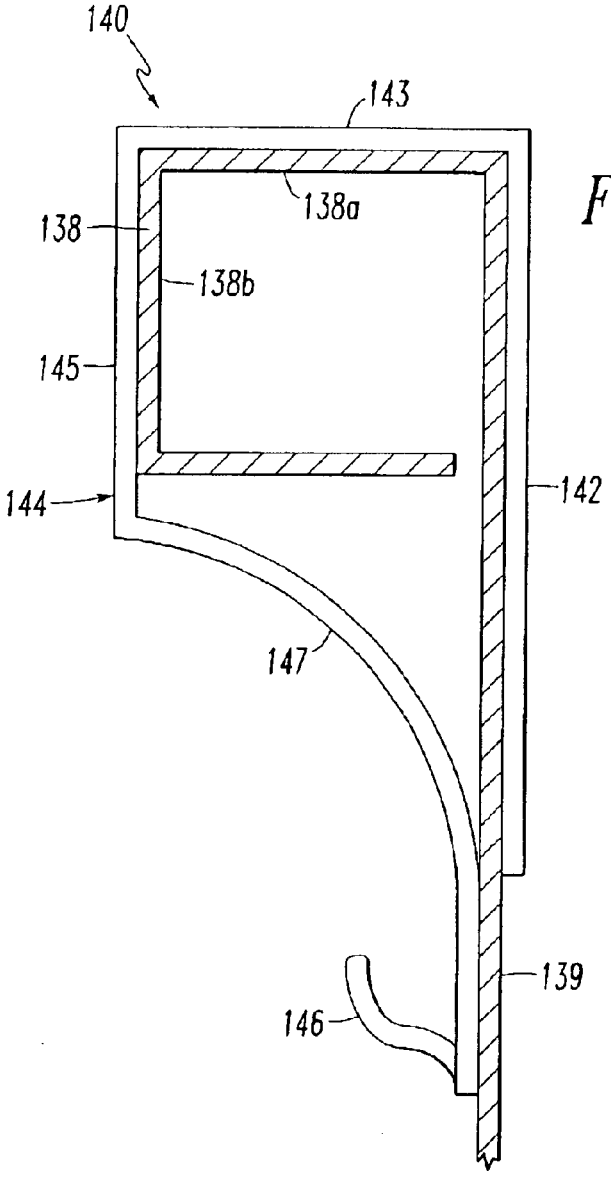
FIG. 27 is a side view of another present preferred bracket placed on a locker door.

The preferred embodiments illustrated in FIGS. 1 through 26 have been described for use on interior and exterior doors of buildings. However, the invention is not so limited. The door hook could be hung on any planar structure having a top surface including room dividers and office partitions, or on cabinet doors or locker doors. Whatever the width of the structure the width of the top of the bracket between the front portion and the rear portion should not be more than 0.025 inches greater than the width of the top surface of that planar structure. Most locker doors are a panel of sheet metal with a metal frame around the interior perimeter of the door. Therefore, I prefer to provide a bracket 140 shown in FIG. 27 which is configured to fit on a locker door 139. The frame 138 on the interior of the door may be a tubular structure as shown, or may be only the top portion 138*a* of that tubular structure, or the top portion and the side portion 138*b* of the tubular structure. This bracket has a rear portion 142, front portion 144 and a top 143 in a U-shaped configuration. The front portion has a straight section 145 having a length not less than the side portion 138*b* of the locker frame 138. A curved section 147 extends from the straight section to abut the locker door and terminates in a hook 146. The bracket 140 is made of a plastic or metal which allows the rear portion 142 and front portion 144 to be spread apart a sufficient amount to place the bracket over the top of a locker door.

Figure 28:
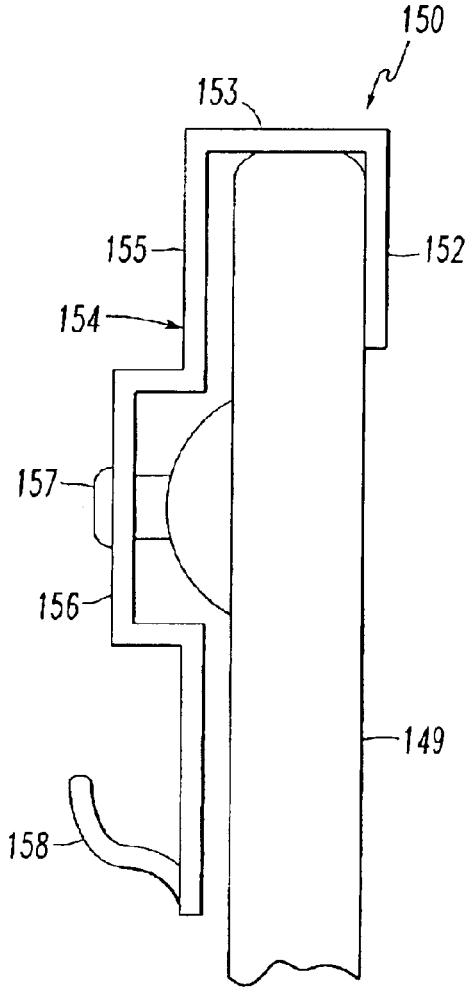
FIG. 28 is a side view of another present preferred bracket placed on a car window.

Another generally U-shaped bracket 150, shown in FIG. 28, fits over a car window 149. This bracket has a rear portion 152, a top 153 and a front portion 154. The front portion has a straight segment 155 adjacent the top, a curved section 156 that holds a suction cup 157 and a hook portion 158. As shown in FIG. 28 this curved section could be formed by a series of straight lines. The suction cup prevents the bracket from sliding along the window. Hook segments are attached to the hook portion 158 of this bracket 150 as in the other brackets here disclosed.

An important advantage for all the embodiments of this door hook is that the door hook can easily be hung on a door by short people who cannot reach the top of the door. Such a person could snap one, two or more segments together with the U-shaped bracket. Then, the user could easily place the assembled structure onto the door. Because of the snap-fit of the hook segments, the assembled structure would be rigid. A beveled edge 69 on the bottom of the bracket 61 shown in FIG. 14 would enable the bracket to more easily fit onto the door. If this structure contains hook segments with card holding fingers like those shown in FIGS. 17, 18, 25 and 26, cards could be placed on the assembled hook segments before the assembled door hook is placed onto the door.

While I have shown and described certain present preferred embodiments of my over-the-door hook it should be distinctly understood that the invention is not limited thereto, but may be variously embodied within the scope of the following claims.

I claim:

1. A door hook adapted to be placed on top of and extend over portions of both sides of a door comprising:

a generally U-shaped bracket having a top, a front portion attached to the top, a back portion attached to the top, and a J-hook on at least one of the front portion and the back portion; and a plurality of hook segments, each segment releasably connected to at least one of the J-hook and another hook segment, each hook segment comprised of:

a flat elongated body of a selected thickness;

a lower end attached to one end of the body and having a thickness less than the selected thickness, a curved hook extending from the lower end and one of a slot and a tooth at a point where the curved hook meets the lower portion; and an upper end attached to an opposite end of the body, the upper end having:

a thickness less than the selected thickness, an opening sized to receive both the J-hook and a curved hook of another hook segment, one of a tab extending into the opening and a recess extending from the opening, the tab sized and positioned to fit into the slot of another hook segment and the recess sized to receive the tooth from another hook segment, such that when a tab of a first hook segment is positioned within the slot of a second hook segment or the tooth of a first hook segment is positioned within the recess of a second hook segment, the first and second segments are locked together and restrained from movement relative to one another.

2. The door hook of claim 1 wherein the thickness of the upper end and the thickness of the lower end together do not exceed the selected thickness of the body.

3. The door hook of claim 1 wherein the J-hook has one of a J-hook slot and a J-hook tooth , the J-hook slot sized and positioned to receive the tooth of a hook segment and the J-hook tooth sized and positioned to fit into the slot of a hook segment.

4. The door hook of claim 3 wherein the J-hook slot is cut at an angle relative to the at least one of the front portion and the back portion.

5. The door hook of claim 1 also comprising at least one strengthening rib attached to at least one of the elongated body, the upper end and the lower end.

6. The door hook of claim 1 wherein at least one of the front portion and the back portion has a J-hook and is configured to have one of a dog leg portion and a curved portion between the J-hook and a location where that front portion or back portion is attached to the top.

7. The door hook of claim 6 also comprising a suction cup attached to the curved portion.

8. The door hook of claim 1 wherein the front portion and the back portion each have a rounded lower edge.

9. The door hook of claim 1 wherein the top is comprised of a spring.

10. The door hook of claim 9 wherein the spring is metal and has a thickness of from about 0.020 inches to about 0.030 inches.

11. The door hook of claim 1 wherein the U-shaped bracket is made of a material selected from the group consisting of stainless steel, brass and polycarbonate.

12. The door hook of claim 1 wherein the top has a bottom surface and at least one of the front portion the back portion is angled inwardly toward that bottom surface.

13. The door hook of claim 1 wherein the U-shaped bracket is plastic, the top has a thickness not exceeding 0.080 inches, and both the front portion and the back portion have a length of at least 1.375 inches.

14. The door hook of claim 1 wherein the U-shaped bracket is metal and the hook segments are plastic.

15. The door hook of claim 1 comprising at least one link, each link comprised of:

an elongated body having at least one opening sized and configured to receive at least one of the J-hook and the curved hook of a hook segment; and a plurality of hooks on the elongated body, each book sized and configured to fit through the opening in the upper end of a hook segment, each link connected to at least one of the J-hook and the plurality of hook segments.

16. The U-shaped door hook of claim 1 also comprising at least one finger attached to the elongated body of one of the plurality of hook segments, the finger sized and positioned to define a slot between the elongated body and the finger that is suitable for holding a greeting card.

17. The door hook of claim 1 wherein the tab is configured as four triangular segments which extend to form a hexagonal opening on the upper end, and the lower end is comprised of a base extending from the lower end and to which the curved hook is attached, the base having a generally hexagonal configuration and containing the slot.

18. The door hook of claim 17 wherein a slot extends through the curved hook, the base and the lower end of the elongated body.

19. The door hook of claim 1 also comprising a ridge on the at least one of the front portion and the back portion, the ridge spaced apart from the J-hook a sufficient distance to allow a portion of the upper end of one of the hook components to be positioned between the ridge and the J-hook.

20. The door hook of claim 1 also comprising a hinge in the flat elongated body of the hook segment, the hinge positioned between the lower end and the upper end of the hook segment.

21. The door hook of claim 1 wherein the front portion and the back portion are spaced apart from one another a distance of 1.375 to 1.4 inches, from 1.75 to 1.8 inches or from 0.5 to 0.525 inches.

22. The door hook of claim 1 also comprising a rod held by the curved hook of at least one hook segment.

23. A door hook adapted to be placed on top of and extend over portions of both sides of a door comprising:

a generally U-shaped bracket having a top, a front portion attached to the top and a back portion attached to the top, a J-hook on at least one of the front portion and the back portion and; and a plurality of hook segments, each segment releasably connected to at least one of the J-hook and another hook segment, each segment comprised of:

a flat elongated body of a selected thickness, an upper end attached to one end of the body, the upper end having:

a thickness less than the selected thickness, an opening sized to receive the J-hook, and a boss extending from a front surface of the upper end and positioned adjacent the opening;

a lower end attached to an opposite end of the body and having a thickness less than the selected thickness, and a curved hook extending from the lower end, the curved hook sized and positioned to fit through the opening in the upper end of a second hook segment and to receive the boss of that second hook segment.

24. The door hook of claim 23 wherein the boss and the curved hook of each hook segment are sized and configured so that the boss and the curved hook snap together.

25. The door hook of claim 23 wherein a cavity is provided in the boss to reduce shrinkage.

26. The door hook of claim 23 also comprising a tab extending into the opening of the upper end of each hook segment and wherein a slot is provided in each hook segment at a position where the curved hook meets the lower end, the slot being sized and positioned to receive the tab.

27. The door hook of claim 23 wherein the thickness of the upper end and the thickness of the lower end together do not exceed the selected thickness of the body.

28. The door hook of claim 23 also comprising at least one strengthening rib attached to at least one of the elongated body, the upper end and the lower end.

29. The door hook of claim 23 wherein the U-shaped bracket is made of a material selected from the group consisting of stainless steel, brass and polycarbonate.

30. The door hook of claim 23 wherein the top has a bottom surface and at least one of the front portion the back portion is angled inwardly toward that bottom surface.

31. The door hook of claim 23 wherein the U-shaped bracket is plastic, the top has a thickness not exceeding 0.080 inches, and both the front portion and the back portion have a length of at least 1.375 inches.

32. The door hook of claim 23 wherein the U-shaped bracket is metal and the hook segments are plastic.

33. The door hook of claim 23 comprising at least one link, each link comprised of:

an elongated body having at least one opening sized and configured to receive at least one of the J-hook and the curved hook of a hook segment; and a plurality of hooks on the elongated body, each hook sized and configured to fit through the opening in the upper end of a hook segment, each link connected to at least one of the J-hook and the plurality of hook segments.

34. The U-shaped door hook of claim 23 also comprising at least one finger attached to the elongated body of one of the plurality of hook segments, the finger sized and positioned to define a slot between the elongated body and the finger that is suitable for holding a greeting card.

35. The door hook of claim 23 also comprising a ridge on the at least one of the front portion and the back portion, the ridge spaced apart from the J-hook a sufficient distance to allow a portion of the upper end of one of the hook components to be positioned between the ridge and the J-hook.

36. The door hook of claim 23 also comprising a hinge in the flat elongated body of the hook segment, the hinge positioned between the lower end and the upper end of the hook segment.

37. The door hook of claim 23 wherein the front portion and the back portion are spaced apart from one another a distance of 1.375 to 1.4 inches, from 1.75 to 1.8 inches and from 0.5 to 0.525 inches.

38. The door hook of claim 23 also comprising a rod held by the curved hook of at least one hook segment.

39. The door hook of claim 23 wherein at least one of the front portion and the back portion has a J-hook and is configured to have one of a dog leg portion and a curved portion between the J-hook and a location where that front portion or back portion is attached to the top.

40. The door hook of claim 39 also comprising a suction cup attached to the curved portion.

* * * * *

UNITED STATES PATENT AND TRADEMARK OFFICE

CERTIFICATE OF CORRECTION

PATENT NO. : 6,854,610 B2
DATED : February 15, 2005
INVENTOR(S) : William E. Adams It is certified that error appears in the above-identified patent and that said Letters Patent is hereby corrected as shown below:

Column 11,
Line 10, change "book" to -- hook --.

Signed and Sealed this

Thirty-first Day of May, 2005

JON W. DUDAS
*Director of the United States Patent and Trademark Office*